United States Patent [19]

Coggins et al.

[11] 4,289,093

[45] Sep. 15, 1981

[54] STEAM GENERATOR

[75] Inventors: Robert W. Coggins; Bert B. Miles, both of Tulsa, Okla.

[73] Assignee: Combustion Engineering, Inc., Windsor, Conn.

[21] Appl. No.: 89,674

[22] Filed: Oct. 30, 1979

[51] Int. Cl.[3] ..... F22B 5/02

[52] U.S. Cl. ..... 122/197; 122/235 K; 122/236

[58] Field of Search ..... 122/197, 235 D, 235 K, 122/236, 195, 23

[56] References Cited

U.S. PATENT DOCUMENTS

| | | | |
|---|---|---|---|
| 1,149,303 | 8/1915 | Stoddard | 122/235 D |
| 1,927,095 | 9/1933 | Lucke | 122/235 D |

FOREIGN PATENT DOCUMENTS

| | | | |
|---|---|---|---|
| 511217 | 5/1952 | Belgium | 122/236 |
| 305827 | 5/1955 | Switzerland | 122/236 |
| 17807 | 8/1912 | United Kingdom | 122/235 D |

*Primary Examiner*—Edward G. Favors

*Attorney, Agent, or Firm*—Arthur L. Wade

[57] ABSTRACT

A steam generator is fired by a fossil fuel burner. The generator is shown as producing approximately 80% quality steam to be injected into oil wells to promote secondary recovery. The flame body from the burner is propagated along the longitudinal axis of a horizontally extended cylindrical chamber. Water and/or steam is passed through tubes mounted on the internal walls of the cylindrical chamber in order that they may absorb radiant heat from the flame body. The heat absorbing tubes are divided into groups, or sets, to establish the rate of water and/or steam flow through the tubes. The tubes within each group are extended as a plurality of reaches the length of the cylinder and are joined to each other by 180° bends of that part of the tube between reaches. Each reach of each tube group is arranged on the internal wall of the cylinder to result in uniform exposure of the tube groups to the radiant heat. Each tube group is connected by a common feed water manifold and the flow into each group from the manifold is positively controlled to maintain uniformity of feed water flow through the tube groups.

6 Claims, 4 Drawing Figures

2
30
31
32
STEAM OUT
FEED WATER IN
18
20
21
22
23
24
25
26
27
28
15
16
17

FEED WATER IN
STEAM OUT
3
2
1

STEAM GENERATOR

TECHNICAL FIELD

Our invention relates to radiant heat exchange sections in which water and/or steam is passed through tubes mounted on the wall of a chamber in which radiant heat of a fossil fuel burner is propagated. In the arrangement and function of water and/or steam tubes on the internal wall of a radiant section of a steam generator, uniformity in exposure of the water and/or steam tubes to the radiant heat is necessary. If the water and/or steam tubes are divided into groups, or sets, connected to a common manifold, arrangement of the reaches of the tubes within each group must compensate for the fact that the flame body may waiver, or flicker, from its preferred axial path. With the flame body deviating from its desired path, the tube reaches of each group must be physically interrelated on the wall of the firing chamber to insure an overall uniformity of exposure to the flame body radiation as between the plural groups.

BACKGROUND ART

80% quality steam has been employed for at least 15 years to elevate the temperature of petroleum-bearing earth formations. Other means have been employed to lower the viscosity of petroleum within formations to promote movement of this material out of the formation and into wells for producing the petroleum to the surface. However, the use of 80% quality steam is well established for this purpose.

There are several competitors manufacturing generators of steam with which to heat earth formations. Of course, there are variations in design between these generators. However, there is a common characteristic of these designs in that a fossil fuel burner is mounted within a housing whose internal walls are lined with tubes through which water and/or steam is passed to absorb radiant heat and convective heat from the flame body and hot flue gases propagated by the burner or burners.

The present problem is in the horizontal cylindrical portion of the steam generator along whose axis is propagated a flame body. It has long been the practice to mount sufficient refractory material on the internal wall of the cylindrical chamber and extend the water and/or steam tube reaches the length of the cylinder, backed by this refractory surface. Obviously, this arrangement enables the radiant heat of the flame body propagated along the axis of the cylinder to be absorbed through the tube walls and into the water and/or steam flowing through the tubes.

In the smaller sizes of steam generators (25–50 MM BTU per hr.), arrangement of the water and/or steam tube reaches is relatively simple. The tube is extended in reaches which are laid along the wall refractory close to each other, with their ends joined to form a continuous passage by welded 180° bends, which bends protrude from each end of the cylindrical chamber. Thus, the water and/or steam tubes are arranged in a serpentine pattern around the periphery of the internal wall of the cylindrical chamber for uniform exposure to the radiant heat of the flame body. The water and/or steam tubes mounted in the radiant section of the generator receive their feed from upstream tubes mounted in the convection section of the generator.

As the demand for larger generators develops, some design problems emerge. The velocity of the feed water and/or steam through a single tube, or pass, in the generator can become so great that an erosion problem will develop. At the same time, with a single tube pass, the differential pressure will become too great.

In considering the total surface provided by tubes in both the radiant and convection sections of the generator, the use of the single tube pass becomes impractical. The designer finds himself juggling the foregoing factors along with acceptable skin temperatures and economical diameters of tubing available. It all becomes too much for the single tube pass construction of the smaller size generators.

For the larger steam generators, plural paths for the water and/or steam through the tubes of the radiant section are required. It is these multiple paths which raise the present problem which must be addressed by the invention. Not only must the flow into each of the separate paths be controlled, but also the absorption of radiant heat by the different tube paths must be substantially equal.

Consider the basic physical arrangement. The chamber in which the burner propagates its flame body is basically a right angle cylinder. The burner, or burners, mounted at one end of this cylindrical chamber, spew a flame body of fuel and air down the axis of the cylindrical chamber. The radiant heat of the flame body radiates to the internal walls of the chamber where the tubes for water and/or steam are mounted against the refractory lining of the internal walls. The flame body is far from a stable, well-defined, radiant body. A turbulent emission from the burner results in the flame body flickering and varying in diameter and length as it extends along the axis of the chamber. With the feed tubes divided into a plurality of groups, they will have to be related to each other as they are laid down along the internal wall of the chamber so as to absorb the radiant heat of the flame body with substantially the same quanity as between the plurality of groups.

DISCLOSURE OF INVENTION

Our present invention initially contemplates dividing the water and/or steam tube to provide a plurality of paths for the feed. The basic division enables the designer to provide the required total radiation-absorbing surface and to establish a maximum feed flow rate through the tubes in controlling internal erosion of the tubes and limiting pressure drop.

Our invention further contemplates the flow regulation through all the water and/or steam tube paths.

Our invention further contemplates tube reaches extending the length of the horizontal cylindrical chamber to embody each water and/or steam tube path. The first reach of each water and/or steam tube path will be sequentially laid down, the second reach of each tube path will be laid down in a second repeating sequence, etc., around the circular periphery of the internal wall of the cylindrical chamber. The first tube reach of the first group will be mounted on the wall next to the first tube reach of the second group. Each first reach of each group is then connected to the second downstream reach of its group by a 180° turn at the end of the cylindrical chamber. The reaches of the plural groups will thus be exposed uniformly to the generated radiation from the waivering flame body of the burner.

The invention further contemplates the distance demanded by the tube reach grouping will obviate the need for specially forged 180° tube bends. The radius demanded by the grouping between reaches of the same group will enable the tube itself to be readily formed into the 180° bend necessary to extend the connected tube reaches to lie parallel to each other along the length of the internal wall of the radiant section shell.

Other objects, advantages, and features of the invention will become apparent to one skilled in the art upon consideration of the written specification, appended claims and accompanying drawings.

BEST MODE FOR CARRYING OUT THE INVENTION

Figures 1, 4:
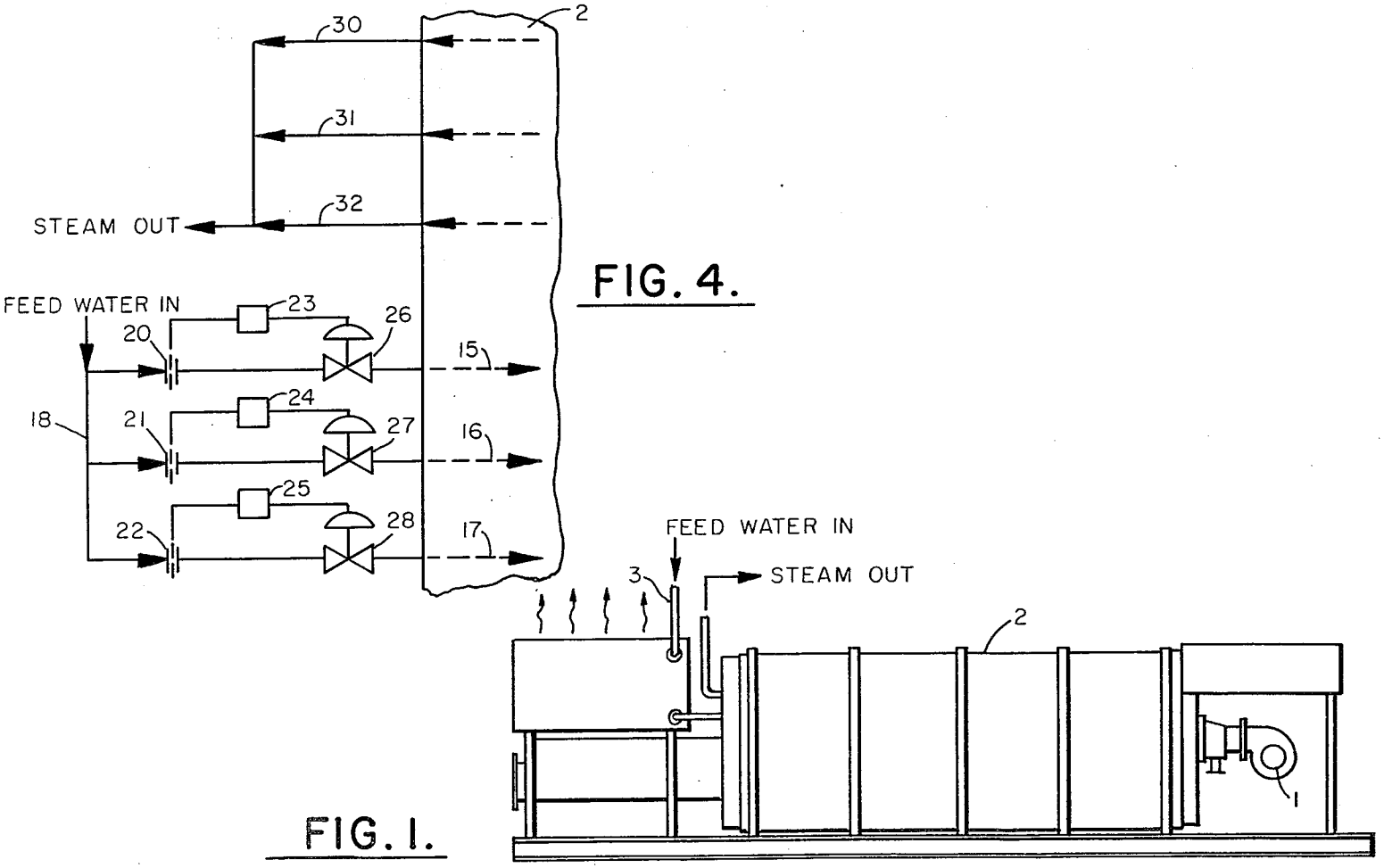
FIG. 1 is a plan view of a steam generator in which the present invention is embodied.
FIG. 4 is a diagrammatic representation of the feed water control system of the generator.

FIG. 1 discloses the outline, profile, or silhouette of a complete steam generator in which the present invention is embodied. Such unit is designed to be skid-mounted in the field, set near the well or wells it supplies with 80% quality steam. Despite its mechanical complexity, the unit is designed to operate without continuous supervision by personnel. Periodic checks of its operations may occur at intervals as long as twelve hours.

In FIG. 1, the generator is built around the operation of burner 1 mounted to propagate its flame substantially the length of the axis of a cylindrical, horizontally extended chamber 2. A source of feed water, not shown, is connected to tubes 3 whose extensions are mounted in the convection of the steam generator. The tubes in the convection section pass their feed water to the downstream tubes extended evenly along the internal walls of the horizontal chamber in order to transfer the radiant heat of the flame of burner 1 into the water and/or steam passed through the tubes in the radiant section.

The products of combustion produced by the flame of burner 1 are ejected from cylindrical chamber 2 and diverted upward through convection section 4. In convection section 4, tubes mounted therein are connected to the downstream tubes in the radiant section to initiate the heating from the products of combustion into the feed water.

After the products of combustion have transmitted their available heat to the water in the tubes of the convection section, they are discharged upwardly. The tubes of this radiant section now discharge steam at a predetermined quality normally 80% which is injected into wells to aid in the secondary recovery of petroleum.

There are many problems of the steam generator which remain unsolved. As an example, if the fuel of burner 1 contains sulfur compounds, the products of combustion discharged upwardly from the convection section 4 will contain these contaminants. Removing the sulfur compounds and other polluting elements is the subject of present research and development in this art. However, the current problem centers about the horizontal, cylindrical chamber 2 where the radiant heat available from the combustion process is absorbed by water and/or steam forced through the tubes mounted therein.

It has become necessary to divide the feed tubes in chamber 2. In designing the steam generator of FIG. 1, the ratio of total surfaces in the convection section and radiation section of the heater is set by several factors not of present concern. When these steam generators are required to absorb over 50 MM BTU per hr., with a water rate exceeding 60,000 lb. per hr., the design parameters of the chamber 2 force the division of the tubes into a plurality of groups connected to a common supply header. This initial division requirement results in the descent of problems to which the present invention is addressed.

The feed tubes of the radiant section are extended in the form of straight, parallel reaches the length of the horizontal cylinder which forms the radiant chamber. A diameter for these tubes could be selected which would give the required total surface exposed to radiant heat, and their feed could be forced through the tubes at a rate below safe film temperature limits. The reaches could be mounted side-by-side around the periphery of the internal wall of chamber 2 and joined in one continuous tube by welded 180° tube bends extending beyond the ends of the cylinder of chamber 2. However, the division of the feed water tube into groups, or sets, of reaches developed a nasty problem of exposing the surfaces of these reaches to the radiant heat of the flame body propagated down the axis of chamber 2.

Unfortunately, the flame body of burner 1 does not extend substantially the length of the axis of chamber 2 with consistent dimensions. The flame body is sustained by combustion air and fuel violently injected into burner 1. Consequently, the flame body is a waivering, flickering mass of burning fuel which radiates heat toward the internal walls of chamber 2 with a distressing inconsistency. So long as the water and/or steam tube reaches were connected in one long passage arranged in a serpentine pattern around the periphery of the chamber 2 cylinder, uneven reception of radiant heat along the lengths of its numerous reaches gave little problem. The feed forced into one end of the tube had a heat exchange with all the heat projected from the flame body as the feed traveled the length of the single passage provided by the tube. Obviously, this will not be the case when the feed tube is divided. If the divisions of the feed tube are not mounted on the internal wall of the chamber 2 cylinder for uniform exposure to the radiant heat, the various divisions of the tube will not produce equal water temperatures and/or equal steam qualities. Therefore, the present invention solves the basic problem of distribution of the several portions into which the feed tube is divided. Distribution relative to the radiant heat of the flame body must produce consistency in temperature and/or quality of the feed discharged from the several portions.

Figure 2:
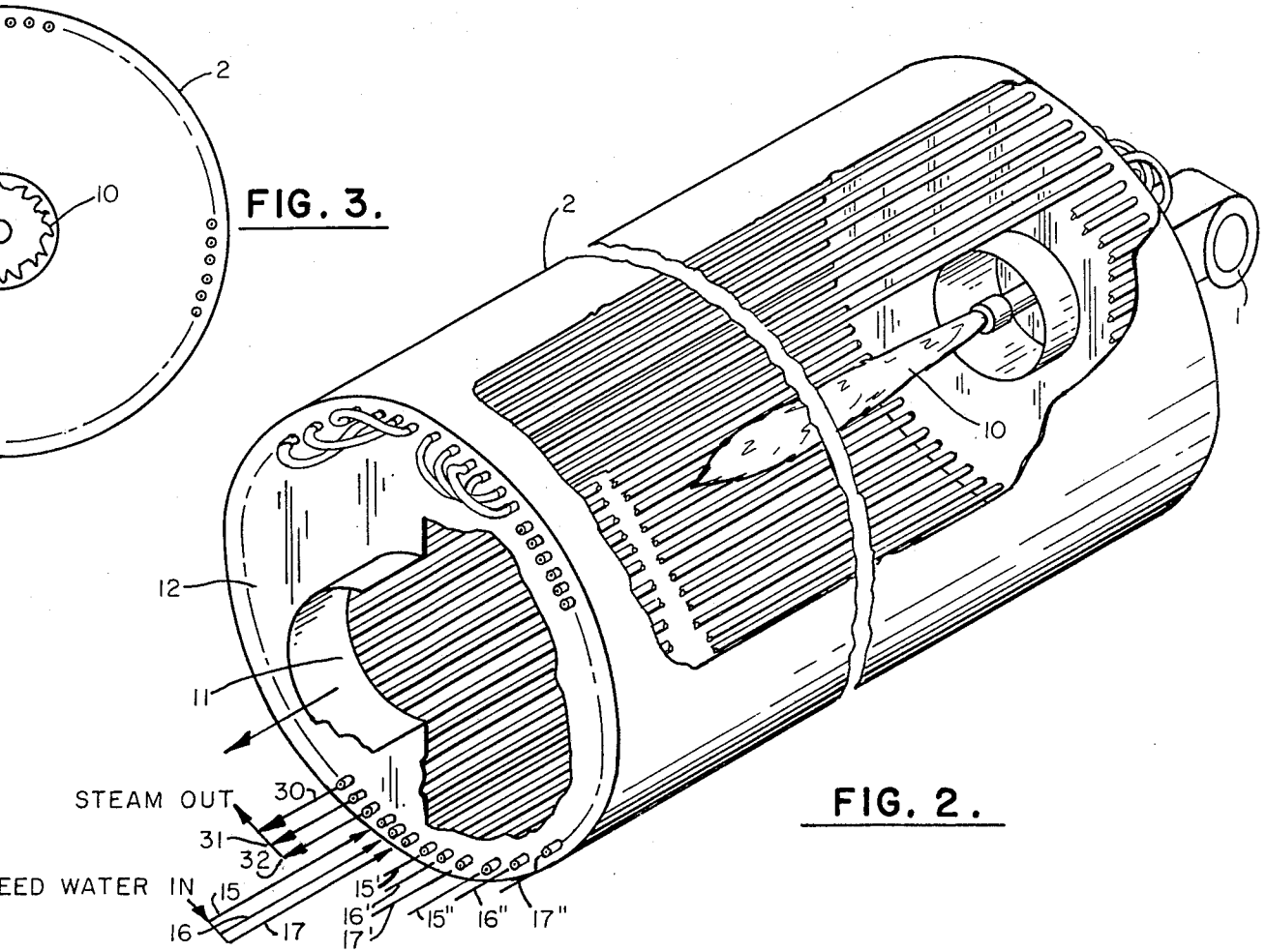
FIG. 2 is a partially sectioned perspective of a radiant chamber of the steam generator.

FIG. 2 discloses the radiant chamber 2 of the FIG. 1 generator in a partially sectioned perspective view. The flame body 10 is now disdisclosed as being emitted from burner 1 down the axis of the cylindrical chamber 2.

Figure 3:
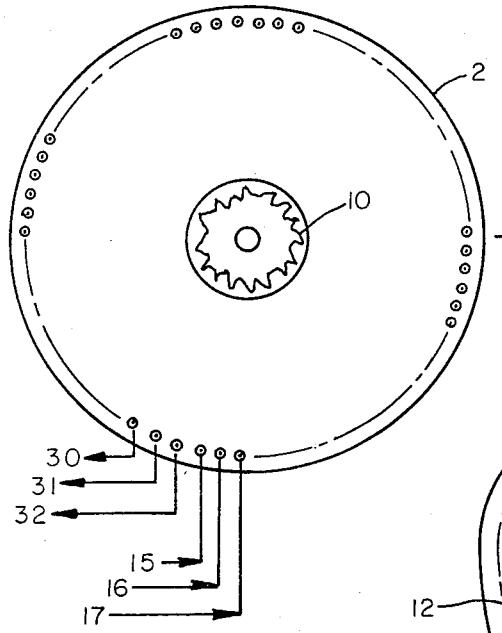
FIG. 3 is a section of the chamber of FIG. 2.

FIG. 3 is a section taken intermediate the ends of chamber 2 and discloses the dramatic view of flame body 10 positioned to transmit its radiant heat toward the internal walls of chamber 2.

Little convection heat is generated within chamber 2. At least a relatively small part of the heat absorbed in chamber 2 is convective. The products of combustion generated by the flame body 10 discharge from opening 11 of end plate 12. These products of combustion are deflected upwardly through conveciton section 4 where they are cooled as they transfer their heat to the tubes mounted in the convection section.

The arrangement of the extensions of the tubes supplied at 3 are not disclosed within convection section 4. Whatever the specific arrangement of these extensions in section 4, the extensions are connected as a common manifold to the tubes mounted on the internal walls of section 2. The present invention concerns itself with the arrangement of these water and/or steam tubes disclosed in FIG. 2 as mounted on the internal walls of section 2.

For purposes of illustrating the present invention, it is essential that the tube reaches are arranged in three groups connected to the tube extensions of section 4. Each of these three groups of tube reaches is arranged relative to each other under the concepts of the invention to assure the uniform absorption of radiant heat from flame body 10.

Each group of reaches is arranged evenly about the periphery of the internal wall of chamber 2. To carry out this arrangement, the first reach of each group is sequentially laid down side-by-side along the internal wall. The second reach of each group is connected to the first reach by 180° tube turn. Therefore, the second reach of each group will be laid down sequentially side-by-side in a repetition of the first arrangement of the first reaches. Subsequent reaches of each of the three groups will be laid down in a repetition of the previous sequence until all reaches of every group are distributed evenly about the complete periphery of the internal wall of chamber 2. With the reaches so laid down, the flickering, unstable, irregular propagation of flame body 10 will have its radiation absorbed by the three groups of tube reaches. As the feed is supplied evenly to the three groups, tube water and/or steam within the three groups will be heated uniformly and will be discharged with substantially the same steam quality and/or water temperature. The discharge end of the three groups may be then manifolded together as the common discharge of 80% quality steam, the product of the steam generator of FIG. 1.

Although the physical relationship between the reaches of each of the groups, or sets, is described accurately above, FIG. 2 is somewhat limited in clearly illustrating what has been described. The inlets to each of the three groups are embodied in tubes 15, 16 and 17. It is clear from the drawing of FIG. 1 that the reaches connected to these three inlets are laid down parallel to each other the length of chamber 2. It is clear from FIG. 2 that subsequent, downstream reaches connected to 15, 16 and 17 are also laid down in the same sequence. The third set of reaches is then laid down in like sequence. This laying down of the reaches at the periphery of the internal wall of chamber 2 continues counterclockwise.

Referring to FIG. 3, reaches 15, 16 and 17 are indicated as being seen down their axes. The next set of downstream reaches is then designated 15', 16' and 17'. To make this arrangement crystal clear, the third set of downstream reaches is designated as 15'', 16'' and 17''. It should now be obvious that this sequence of reaches is repeated until the periphery of the internal wall of chamber 2 is evenly covered by the reaches. So arranged, each of the three groups of reaches for the water and/or steam will receive one-third of the radiation absorbed from flame body 10.

The next problem is the connection of the reaches of each group. Reach 15 will be connected to reach 15' by a tube section bent to couple the ends of the reaches. First, the tube bend will have 180° change in direction. Second, the tube bend for these reaches 15 and 15' will be distorted to accommodate a similar tube bend joining reach 16 to reach 16'. FIG. 2 illustrates the distortion of the three tube bends necessary to join tube reaches 15, 16 and 17 to their respective downstream tube reaches.

The pattern of interwoven tube bends extends beyond the length of the cylindrical shell of chamber 2. FIG. 2 and FIG. 3 provide ample disclosure of how this problem is successfully addressed. Fortunately, the radius of the 180° tube bends is great enough to obviate special 180° tube bends. Sections of the tubes themselves can be formed and welded to the ends of the reaches.

Finally, referring to FIG. 4, the control system for feed water flow through the plural groups, or sets, of reaches is disclosed. Reaches 15, 16 and 17 are disclosed as receiving feed from the common manifold 18. Manifold 18 represents the tube extensions of section 4 which uniformly supply their heated feed to the reaches of the radiant section 2.

Of course, measurement and control of the feed water to the three groups of reaches in radiant section 2 could be carried out elsewhere in the system. FIG. 4 teaches that a flow into each tube reach can be detected by orifices 20, 21 and 22. The differential pressures across each of these orifices are transmitted to control systems 23, 24 and 25. The output control signal is generated within each of the systems 23, 24 and 25 for application to regulating valves 26, 27 and 28. Therefore, the flow through each of the three groups of reaches in radiation chamber 2 is detected by an orifice. A control system responds to the signal from the orifice and establishes an output control signal which is applied to a valve establishing the rate of flow to the same set of tube reaches whose flow rate has been detected. The control system can provide a set point to maintain the desired flow rate from manifold 18. Obviously, the three groups of tube reaches can thus have the flow rates controlled to a common value. The result is even flow of feed water through the plural flow paths in chamber 2.

The output of the three groups, or sets, of reaches is designated 30, 31 and 32. With the flow rate of feed water maintained the same between the groups of reaches and the absorption of radiant heat from burner 10 equally absorbed by the feed water of the groups, or sets, the temperatures of the 80% quality steam from outlets 30, 31 and 32 are equal. These outlets can then be manifolded together to supply the steam for formation heating, courtesy of the present invention.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown n the accompanying drawings is to be interpreted in an illustrated and not in a limiting sense.

We claim:

1. A steam generator, including, a shell in the form of a right angle cylinder horizontally extended, a burner mounted at the first end of the shell to propagate a body of flame along the axis of the shell for a substantial length of the shell, a source of feed water, a first set of water and/or steam tube reaches connected to the source of feed water and mounted to extend the length of the shell and spaced equally about the circumference of the internal wall of the shell, and a second set of water and/or steam tube reaches connected to the source of feed water and mounted to extend the length of the shell and spaced equally about the circumference of the internal wall of the shell with each of the reaches of the second set paired with a reach of the first set of reaches about the circumference of the shell.

2. The generator of claim 1, in which, the tube reaches within each of the first and second sets are connected in series by 180° turn in the section of tube between each pair of reaches.

3. The generator of claim 1, including, a separate feed flow rate controller connected to each set of tube reaches to regulate the flow of feed water from the source through the sets.

4. A radiant heat section in a steam generator, including, a housing in the form of a cylindrical shell horizontally oriented, a burner mounted to propagate a flame body substantially the length of the axis of the cylinder in radiating heat toward the internal wall of the housing shell, refractory lining the internal wall of the housing shell, tube reaches extending the length of the housing shell and mounted at the refractory lining the internal wall of the housing shell, connections between a first set of the tube reaches to form the first set of tube reaches into a first continuous path to contact water and/or steam as it is heated by the radiant heat of the flame body, a connection between the source of feed and the first set of tube reaches to supply feed to the first path formed by the reaches, a second set of tube reaches to form a second path for feed with each of the reaches of the second set paired with a reach of the first set about the circumference of the internal wall, and a connection between the second set of tube reaches and the source of feed water.

5. The radiant heat section of claim 4, in which, a first feed water flow rate controller is connected in the first path and a second feed water flow rate controller is connected in the second path to maintain the flow rates in the paths equal.

6. A radiant heat section in a steam generator, including, a housing in the form of a cylindrical shell horizontally oriented, a burner mounted to propagate a flame body substantially the length of the axis of the cylinder in radiating heat toward the internal wall of the housing shell, refractory lining the internal wall of the housing shell, tube reaches extending the length of the housing shell and mounted at the refractory lining the internal wall of the housing shell, connections between a first set of the tube reaches to form the first set of tube reaches into a first continuous path to contact water and/or steam as it is heated by the radiant heat of the flame body, a connection between the source of feed and the first set of tube reaches to supply feed to the first path formed by the reaches, a second set of tube reaches to form a second path for feed with each of the reaches of the second set paired with a reach of the first set about the circumference of the internal wall, a connection between the second set of tube reaches and the source of feed water, a third set of tube reaches to form a third path for feed with each of the reaches of the third set grouped with the pairs of the first and second reaches about the circumference of the internal wall, and a connection between the third set of tube reaches and the source of feed water.

* * * * *